United States Patent [19]

Tong et al.

[11] Patent Number: 4,959,126

[45] Date of Patent: Sep. 25, 1990

[54] PROCESS FOR DECOKING A DELAYED COKER

[75] Inventors: Wuwei Tong, LuoYang; Deyu Sun, ShenYang; Qingyuan Zhang, LuoYang; Lielai Wu, LuoYang; Shicheng Zhou, LuoYang; Shande Yu, Shanghai; Daoji Du; Shili Yang, both of LuoYang, all of China

[73] Assignees: LuoYang Petrochemical Engineering Corporation SINOPEC (LPEC), LiTun, LongMenZhen, LuoYang, China; Institut Francais du Petrole, Rueil Malmaison, France

[21] Appl. No.: 198,809

[22] Filed: May 25, 1988

[30] Foreign Application Priority Data

May 25, 1987 [CN] China ..... 87103735
Apr. 25, 1988 [CN] China ..... 88102514.3

[51] Int. Cl.[5] ..... C10B 33/00

[52] U.S. Cl. ..... 201/2; 134/22.18; 134/24; 134/39

[58] Field of Search ..... 201/2; 202/241; 134/22.18, 24.34, 39; 239/240

[56] References Cited

U.S. PATENT DOCUMENTS

| | | | |
|---|---|---|---|
| 2,245,554 | 6/1941 | Court | 141/1 |
| 2,254,848 | 9/1941 | Holveck | 103/41 |
| 3,544,012 | 12/1970 | McNally | 239/240 |
| 3,920,537 | 11/1975 | Walker | 48 R/ |
| 3,985,572 | 10/1976 | Petermann et al. | 134/22.18 |
| 4,107,001 | 8/1978 | Kinzler | 202/241 |
| 4,571,138 | 2/1986 | Farajun | 414/323 |
| 4,611,613 | 9/1986 | Kaplan | 134/95 |
| 4,626,320 | 12/1986 | Alworth et al. | 201/2 |
| 4,673,442 | 6/1987 | Kaplan | 134/24 |
| 4,828,651 | 5/1989 | Lumbroso et al. | 201/2 |

FOREIGN PATENT DOCUMENTS

| | | | |
|---|---|---|---|
| 376431 | 8/1973 | U.S.S.R. | 202/241 |
| 445349 | 3/1984 | U.S.S.R. | 202/241 |

*Primary Examiner*—Joye L. Woodard
*Attorney, Agent, or Firm*—Millen, White & Zelano

[57] ABSTRACT

The present invention relates to decoking of a residual oil delayed coke reactor. When decoking, the roller of the flexible pipe winch is rotated to cause the flexible pipe to vertically ascend or descend in the coker wherein the high pressure water rotates the turbine blades of the turbine-reductor which brings the drilling and cutting combination unit into rotation so as to drill a through hole in the coke accumulation and then conduct the decoking operation. The drilling and cutting combination unit is equipped with a pressure control unit so that switchover of the drilling and cutting operations can be automatically performed. The present invention eliminates the use of a derrick, resulting in significant savings in time, quantity of steel, capital investment, and equipment required to facilitate the decoking process and enhance decoking efficiency.

11 Claims, 4 Drawing Sheets

PROCESS FOR DECOKING A DELAYED COKER

BACKGROUND OF THE INVENTION

1. Field of the Invention

The present invention relates to improvements in decoking residual oil delayed cokers and to apparatus decoking.

2. Description of the Prior Art

It is well known that during delayed coking, a stream of residual oil passes through the pipes of a heater at a high flow rate, where the residual oil is heated to the temperature required by the coking reaction, and then enters a coker where it undergoes reactions such as cracking, condensation, etc. with the help of its entrained heat. The oil-vapors produced thereby are introduced nto a fractionating column for fractionation and the coke deposited in the coker is periodically removed after it has accumulated to a given height (Hydrocarbon Processing, Vol. 50, No. 7, 1971).

Early decoking of the delayed coker was carried out using a coiled steel rope, which was inserted into the empty coker from top to bottom and then drawn out with a hoist after the coke accumulated in the coker to a given height. This decoking procedure was time-consuming ineffective, and labor-intensive.

In order to overcome the above-mentioned disadvantages, a hydraulic decoking technique using a derrick was proposed. This process invented in the United States during the 1930's, is still widely used for decoking in the delayed coking process.

The aforementioned hydraulic decoking technique employs a high speed, high impact water jet to remove coke from a coker, which process essentially consists of two operations: bore drilling and coke cutting. In this hydraulic decoking process a derrick, measuring about 40 m in height and positioned on the top platform of the coker, is used to deliver high pressure water through a hollow drill rod supported on the derrick to a coke remover. A high pressure water pump forces water through a high pressure rubber hose. Using drilling means, a hole is bored in the coke accumulation and finally high pressure water is ejected from the nozzle of the coke remover to accomplish decoking (Petroleum Processing, Vo. 5, No. 2, 1950).

In addition the above-noted components, operation of this hydraulic decoking technique requires a hoist, an overhead crane, sling hook, and other associated means. The drill rod and coke remover are brought into rotation by an air-operated motor. The derrick and hoist are used to raise and lower the drilling means and the coke remover, as desired, with the help of the steel ropes (Petroleum Processing, Vo. 5, No. 2, 1950).

Compared to the early steel rope decoking process, the hydraulic decoking technique is more efficient, safer, and environmentally cleaner. However, environment, it should be noted that this hydraulic decoking technique requires the use of a considerable amount of heavy, structurally complicated equipment, steel, and major expenditures, since each coker must be equipped with a steel derrick and its own coke removing apparatus. Additionally, the 40 m height of the derrick hinders operation and maintenance.

Recently, the development of the delayed coking process has resulted in cokers with layer diameters and harder, high quality coke; therefore, it is necessary to correspondingly raise the pressure and flow rate of the high pressure water jets used for removing coke. Accordingly, continuous improvements have been made on the decoking process and apparatus as embodied, for example, in U.S. Pat. Nos. 3,412,012 and 3,836,434.

U.S. Pat. No. 3,412,012 discloses a decoking process wherein a high, above-ground derrick is needed. In addition, the drill stem must be kept continuously rotating. When the coke accumulates to a given height, the coke remover performs decoking by ejecting a high pressure water jet. However, this procedure increases energy consumption, a significant disadvantage of this decoking process.

According to U.S. Pat. No. 3,836,434, a central bore is drilled and then high pressure water is ejected against the coke accumulation from top to bottom in order to decoke by "peeling" or enlarging the central bore diameter. This apparatus, which includes a conducting mechanism, control means and valve, is complex and the operator cannot automatically switch between drilling and cutting operations increasing the adjustment, thereby increasing the adjustment requiring frequent adjustments and lengthening the procedure. Furthermore, a derrick is also required.

Both the above-described and subsequent hydraulic decoking techniques utilize a rigid drilling means, the process and apparatus thereof have numerous disadvantages including:

1. More, structurally complicated equipment and high investment costs associated with using a derrick.
2. Switching between bore drilling and the coke cutting is not automatic complicating operation and limiting the efficiency of decoking.

SUMMARY OF THE INVENTION

The present invention is intended to overcome the disadvantages of the prior decoking techniques by providing a new process for removing coke from a delayed coker which does not require a derrick and wherein the drilling and cutting operations can be automatically switched over.

Accordingly, one object of the invention is to provide a new decoking process wherein a flexible pipe is used in place of the rigid drill rod and a winch or reel is employed to coil and uncoil the flexible pipe inside the coke remover which makes it possible to eliminate the derrick and its associated structure.

Another object of the invention is to improve the existing decoking apparatus including, in particular, the coke remover so as to further improve decoking efficiency.

According to the present invention, a process is provided for decoking a residual oil delayed coker with water dispensed from a nozzle array comprising by pumping high pressure water preferably at 12.0–25.0 MPa, through a flexible pipeline into a vertically suspended hollow drive shaft by channeling the water an axial path passing through a hollow hub of a reel around which through the flexible pipeline is wound and then channeling the water radially of the hub and into a first end of the flexible pipe, ejecting the water from the nozzle array in a downward direction with respect to the axis of the flexible pipe at a first pressure while unreeling the flexible hose from the reel to bore a hole through the coke in the coke reactor, changing the water pressure from a first pressure to a second pressure, and ejecting the water from the nozzle array in a lateral direction at the second pressure to discharge coke lining the bore from the reactor while reeling the flexible pipe on the reel.

The apparatus used for the present decoking process comprises the flexible pipe winch, the flexible pipe, the turbine-reductor and the coke remover. The upper end of the flexible pipe is connected with the hollow drive shaft of the winch roller through an elbow and the lower end is connected with the turbine-reductor and the coke remover. The flexible pipe winch can make reciprocating movement along the rails bridged on the top platforms of several cokers in order to realize periodic decoking operations of more cokers. The coke remover can be raised or lowered vertically in the coker by means of the flexible pipe winch wherein the roller of the winch is rotated to coil and uncoil the decoking flexible pipe. The high pressure water makes the blades of the turbine-reductor rotate which brings the coke remover into rotation after its speed is reduced through the reductor. Within the coke remover is installed a pressure control means which is used for the automatic switchover of the drilling and cutting operations by changing the water pressure.

DETAILED DESCRIPTION

Figure 1:
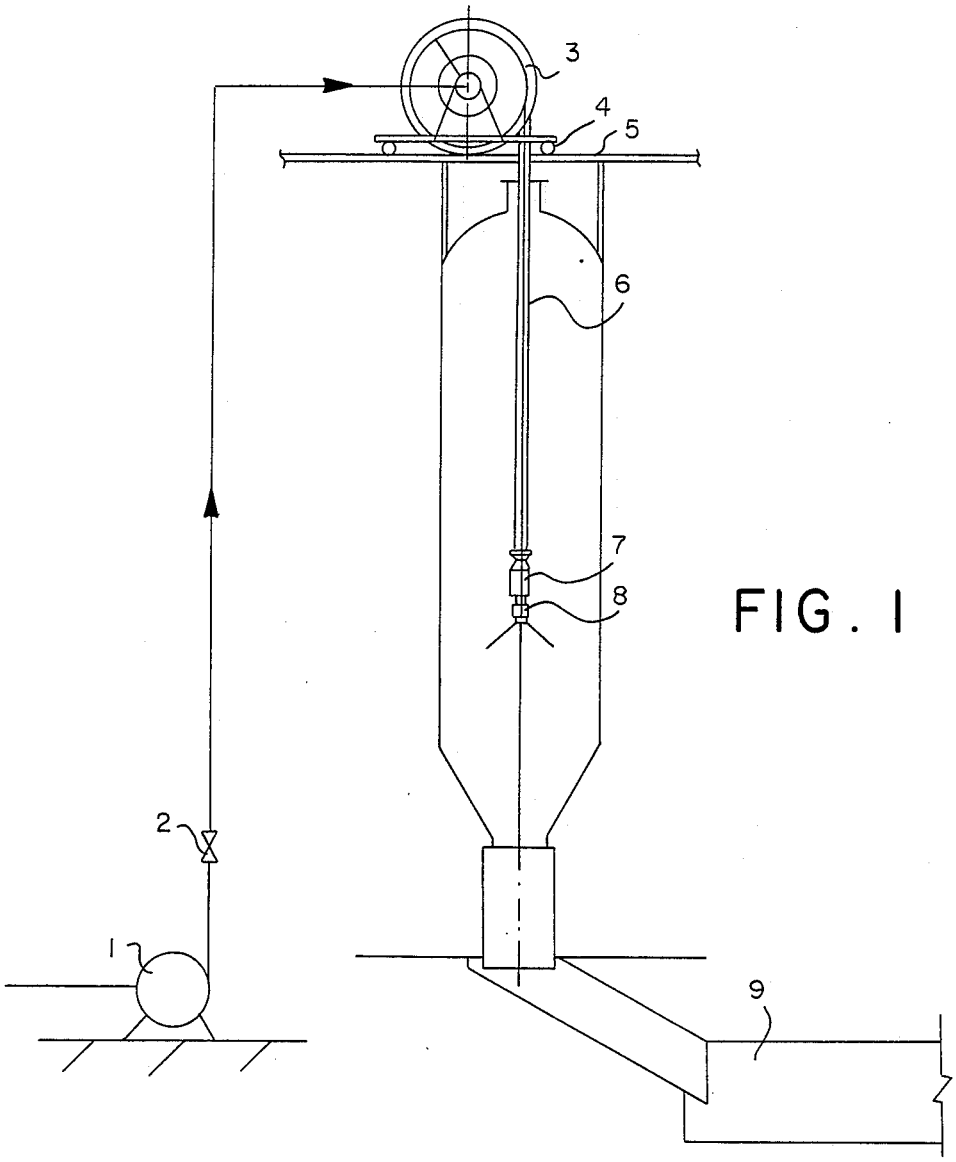
FIG. 1 is a side schematic diagram of the decoking apparatus which is utilized to practice the process of the present invention.

As shown in FIGS. 1–5, when a decoking operation is performed according to the invention, the high pressure water pump 1 is started which introduces high pressure water of 12.0–15.0 MPa into the turbine-reductor through the control gate valve, short rubber pipe and snap-action movable connector, the hollow drive shaft 15 of the flexible pipe winch and the decoking flexible pipe. Then the high pressure water rotates the turbine blades which bring the coke remover in the form of a nozzle array 8 into rotation. A bore of about 0.8–1.2 m in diameter is drilled throughout the coke accumulation by three drilling nozzles which eject three jets of high pressure water of about 10.0–13.0 MPa against the coke. Then the water pressure is increased to about 18.0–22.0 MPa using the control gate valve 2. The action of the pressure control unit 36 closes the flow channel of the drilling branches 34 and at the same time opens the cutting valve piston 30. Thereupon the cutting nozzles (28) carries out the decoking by ejecting two horizontal jets of high pressure water of about 16.0–20.0 MPa. The cut-off coke discharged via the outlet at the bottom of the coker is collected in the coke storing pool 9.

The high pressure water pump 1 and the control gate valve 2 shown in FIG. 1 are products of conventional design. For example, high pressure water pumps manufactured by Shenyang Water Pump Factory (Lianoning Province, China) can be suitably used. The flexible pipe winch or reel 3 is equipped with wheels 4 which can make reciprocating movement along the rails bridged on the top platforms of several cokers at a speed of 14–18 m/min.

Figure 2:
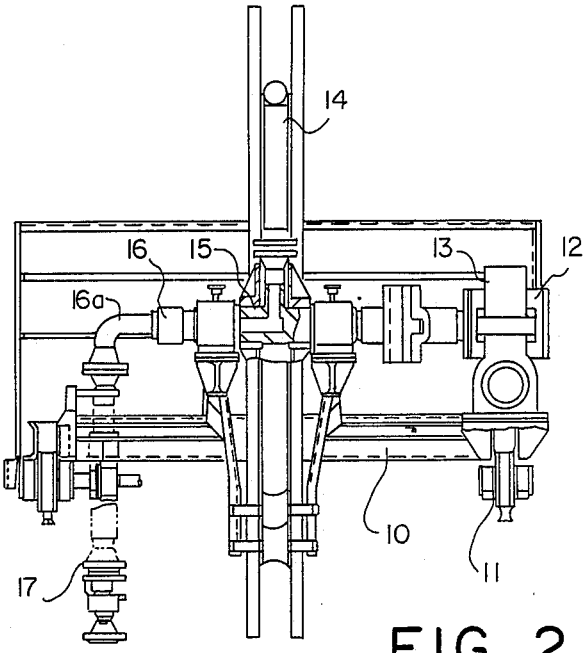
FIG. 2 is a front view partially in section of the flexible pipe winch.

The flexible pipe winch or reel 3, as shown in FIG. 2, comprises a supporting frame 10, a drive mechanism 11 for the reciprocating movement, a worm reducer 12, a winch drive mechanism 13, a flexible pipe roller 14, a hollow drive shaft 15, a seal box 16, short rubber pipe **16*a* and snap-action movable connector 17. Among these components, the flexible pipe roller 14 is the principle one. The flexible pipe can be wound around the roller. A hollow drive shaft 15 is provided at one side of the roller 14, on the central part of which extends an elbow which is connected with the decoking flexible pipe 6. At the end of the hollow drive shaft 15 there is a seal box 16. An elbow and short rubber pipe, which is in flow communication with the seal box, is connected with the pipeline through the snap-action movable connector 17. The opposite end of the hollow drive shaft 15 is coupled with the winch drive mechanism 13 so as to make the roller 14 rotate at a speed of 0.4–5 m/min. The winch drive mechanism 13 with a speed governing an electric motor (not shown) and a worm reductor 12 brings the roller 14 which is mounted on the hollow drive shaft 15** into rotation.

Figure 3:
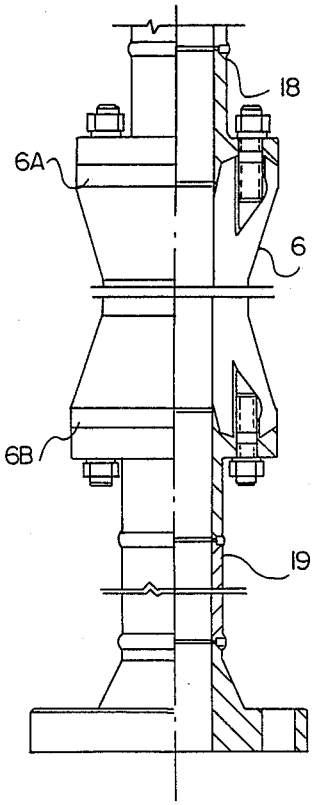
FIG. 3 is a side view partially in section of the flexible pipe with upper and lower connectors.

The decoking flexible pipe 6 (also known as to hydraulic decoking rubber pipe) is shown in FIG. 3. Use may be made of the flexible pipe manufactured by, for example, the Zhongnan Rubber Factory (Hubei Province, China). A flexible pipe suitable for use may be in the range of about 36–40 m long with an inner diameter in the range of of about 75–130 mm without any joint on it. The upper end of the pipe is connected with the central elbow on the hollow drive shaft 15 of the winch roller or reel 14 through the steel conduit 18 and its lower end is coupled with the turbine-reductor or water-driven turbine 7 through the steel conduit 19. The connection is accomplished by means of flanges 6A, 6B. The decoking flexible pipe in use is preferably an integral one without any joints throughout the whole length. Its working pressure is about 12.0–25.0 MPa and its torque momentum about 300–600 kg.m.

Figure 4:
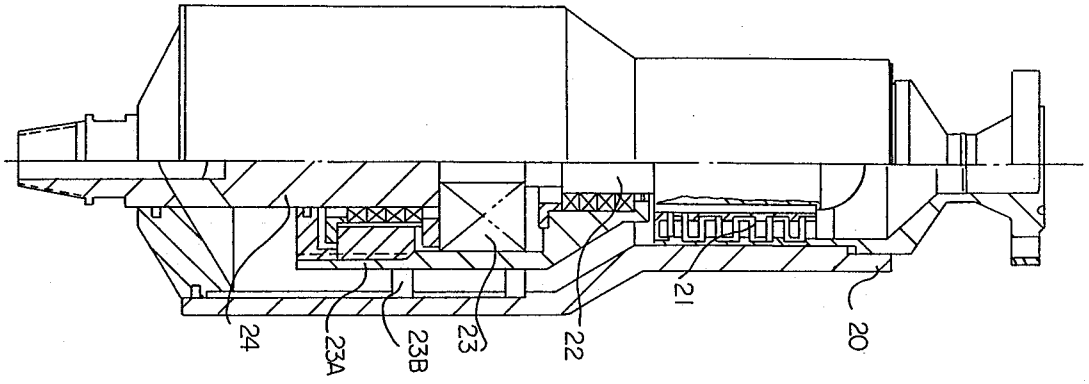
FIG. 4 is a side view partially in section of the turbine-reductor.

The water-driven turbine 7, as shown in FIG. 4, comprises cylindrical casing 20, turbine blades 21, an input shaft 22, a reductor 23 and an output shaft 24 and is essentially characterized in that the input shaft 22 and the output shaft 24 are supported by the outer casing 23A of the reductor 23 and the supporting keys 23B of the reductor 23 and the supporting keys 23B on the outer casing 23A of the reductor 23 is fitted into the groove of the cylindrical casing 20. Such an arrangement provides a simple and compact construction, less pivot points, and less sealing joints. The use of the wear-resistant PTFE therein will decrease the pressure loss and frictional resistance. The output power of the water-driven turbine 7 is in the range of about 3–6 h.p. with a speed of 8–12 rpm.

Figure 5:
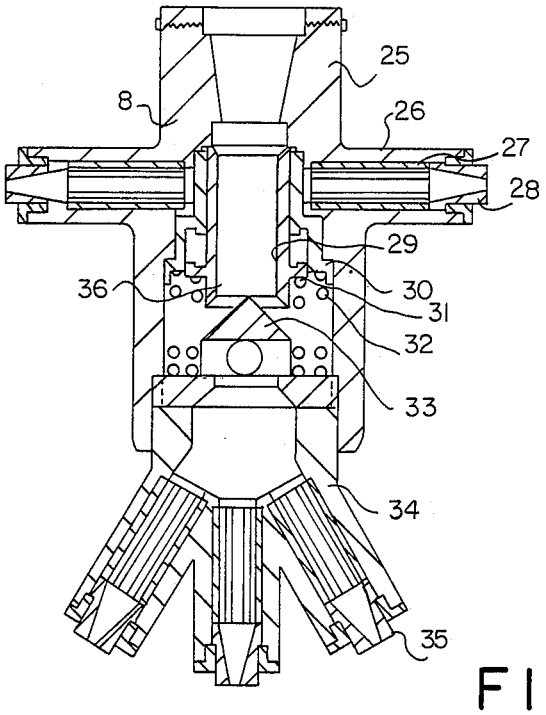
FIG. 5 is a side view partially in section of the drilling and cutting combination unit or nozzle away.

The drilling and cutting combination unit is a nozzle array 8 shown in FIG. 5 comprises a cylindrical casing 25, cutting branches, flow stabilizers 27, cutting nozzles 28, a pressure control unit 36 composed of a drilling valve piston 29, a cutting valve piston 30, an inner spring 31, an outer spring 32 and a valve core 33, drilling branches 34 and drilling nozzles 35. Three drilling nozzles are equipped at the lower end of the coke drilling branches with the central one directed substantially vertically and downwardly and the two side ones each symmetrically inclined to respective sides by about 20–30° from the central one. The through hole drilled in the coke accumulation is about 0.8–1.2 m in diameter. Two cutting nozzles of the coke cutter are horizontally and symmetrically mounted at the same height at the respective ends of the cutting branches. There are flow stabilizers inside the drilling branches and the cutting branches. Such a combination unit according to this invention is characterized in that the higher working pressure and the greater impact force increase drilling and cutting efficiency. When the water pressure is about 12.0–15.0 MPa for drilling, the drilling valve piston 29, cutting valve piston 30 as well as the springs 31, 32 of the pressure control unit 36 remain at the stop position. After the bore drilling is finished and the water pressure is increased to about 18.0–22.0 MPa, the inner spring 31 is compressed and the drilling valve piston 29 is moved downward to well fit with the valve core 33, thereby closing the flow channel to the drilling branches 34 while opening the cutting valve piston 30. Then decoking operation is performed with the high pressure water in the form of jets via the cutting branches 26.

With the turbine-reductor and the coke remover of the present invention, in contrast to the above-described known decoking techniques, the switchover from drilling to cutting operations is accomplished automatically to further enhance decoking efficiency. Naturally, the present turbine-reductor and the coke remover may also be applied to the derrick hydraulic decoking technique.

The advantages of the process for decoking a residual oil delayed coke reactor using a flexible pipe and apparatus thereof according the present invention may be summarized as follows:

1. The present invention has eliminated the use of a derrick and associated means such as a sling hook and overhead crane etc. and replaced the rigid drill rod with a flexible pipe. In addition, one decoking apparatus is sufficient to serve four cokers, resulting in significant swings in steel, investment capital and equipment required.

2. The flexible pipe decoking process is convenient to operate and to maintain owing to the elimination of the conventional derrick measuring about 40 m in height.

3. Use of the drilling and cutting combination unit makes it possible to automatically switchover the operation from drilling to coke cutting or vice versa, thus saving time otherwise required to change the drill or plug the nozzles and further enhancing decoking efficiency.

4. Noise is lowered since a turbine-reductor is used in place of an air-operated motor thereby significantly improving the operating plant environment.

The following table compares the results of the present flexible pipe decoking process and the known derric hydraulic decoking technique. The example should not be construed as limitative, however.

The residual oil delayed coke reactors with a capacity of one million tons per year using Daqing vacuum residual oil as the starting material are operated according to the flexible pipe decoking process of the present invention and the known derrick hydraulic decoking technique, respectively. The results are listed in the following table:

TABLE

| | Flexible pipe decoking | Derrick hydraulic decoking |
|---|---|---|
| Coke Drilling: | | |
| Pressure, MPa | 12–25 | 10.5–11.0 |
| Flow rate, $m^3$/hr. | 200–240 | 170–180 |
| Time, min. | 15–20 | 15–25 |

TABLE-continued

| | Flexible pipe decoking | Derrick hydraulic decoking |
|---|---|---|
| Coke cutting: | | |
| Pressure, MPa | 18–22 | 12.0–12.5 |
| Flow rate, $m^3$/hr | 250–300 | 185–190 |
| Time min. | 70–90 | 85–105 |
| Total decoking time,min. | 85–110 | 110–140# |
| Water consumption $m^3$/ton of coke | 1.1–1.4 | 1.5–1.8 |
| Power consumption, Kw.Hr/ton of coke | 8–10 | 11–13 |
| Decoking capacity, t/hr. | 160–200 | 100–140 |

#inclusive of about 10 minutes for changing the drill (or plugging the nozzles)

What is claimed is:

1. A process for decoking at least one residual oil delayed coke reactor comprising:

pumping water at high pressure through a flexible pipeline suspended vertically with respect to the reactor by channeling the water through a path passing axially through an axis of a hollow drive shaft of a reel around which the flexible pipeline is looped and then channeling the water radially of the drive shaft and into a first end of the flexible pipeline;

ejecting the water from a nozzle array connected to a second end of the flexible pipeline in a downward direction with respect to the axis of the reactor at a first pressure while unreeling the flexible pipeline from the reel to drill a hole through the coke in the coke reactor;

changing the water pressure from a first pressure to a second pressure; and ejecting the water from the nozzle array in a lateral direction at the second pressure to cut and discharge coke lining the bore from the reactor while reeling the flexible pipeline on the reel.

2. A process in accordance with claim 1, wherein said reel rotates at a linear speed of about 0.4–5 m/min.

3. A process in accordance with claim 1, wherein said flexible pipeline is in the range of about 36–40 m long and in the range of about 75–130 mm in diameter without any joints throughout its entire length and has a working pressure in the range of about 12.0–25.0 MPa and torque moment in the range of about 300–600 kg.m.

4. The method of claim 1, wherein the second pressure is higher than the first pressure.

5. A process in accordance with claim 4, wherein the high pressure water has a pressure in the range of about 12.0–15.0 MPa when drilling and in the range of about 18.0–22.0 MPa when cutting.

6. A process according to claim 4, wherein the high pressure water has a pressure in the range of about 12.0–25.0 MPa.

7. The process of claim 4, further including the step of automatically stopping downward ejection of water and initiating lateral ejection of water upon changing the water pressure from the first pressure to the second pressure.

8. The process of claim 4, further including the step of rotating the nozzle array with a water-driven turbine disposed between the flexible pipeline and the nozzle array, the water-drive turbine having a rotating output powered by the same stream of water dispersed by the nozzle array.

9. A process in accordance with claim 8, wherein the output power of the water-driven-turbine is in the range of about 3–6 h.p. with a speed in the range of about 8–12 rpm.

10. The process of claim 8, further including the step of reeling the flexible pipeline onto the reel to withdraw the nozzle array from the coke reactor and moving the nozzle array into alignment with another coke reactor by rolling the reel with the nozzle array retracted on a rail-supported carriage to another coke reactor, where the steps of claim 1 are repeated.

11. The process of claim 10, wherein the nozzle array includes lateral and downwardly opening nozzles and wherein automatically stopping downward ejection of water and initiating lateral ejection of water is accomplished by moving a valve within the nozzle array against the bias of a spring from a first position blocking the lateral opening nozzles and clearing the downwardly opening nozzles to a second position blocking the downwardly opening nozzles and clearing the laterally opening nozzles.

* * * * *